United States Patent [19]

Woolfolk

[11] Patent Number: 4,769,638

[45] Date of Patent: Sep. 6, 1988

[54] COLOR GRAPHICS INFORMATION DISPLAY

[76] Inventor: Robert L. Woolfolk, 7127 Churchill Way, Dallas, Tex. 75230

[21] Appl. No.: 924,751

[22] Filed: Oct. 30, 1986

[51] Int. Cl.[4] ..... G09G 3/16

[52] U.S. Cl. ..... 340/763; 40/449; 40/426; 340/815.08; 340/815.1

[58] Field of Search ..... 340/763, 764, 783, 815.08, 340/815.04, 815.05, 815.10, 815.14, 815.24, 815.25, 815.26, 815.27, 815.28, 815.29; 40/463, 466, 484, 449; 74/198, 471

[56] References Cited

U.S. PATENT DOCUMENTS

| | | | |
|---|---|---|---|
| 3,036,300 | 5/1962 | Knight | 40/449 |
| 3,140,553 | 7/1964 | Taylor | 340/815.24 |
| 3,295,238 | 1/1967 | Winrow | 40/463 |
| 3,365,824 | 1/1968 | Winrow | 40/463 |
| 3,469,258 | 9/1969 | Winrow | 340/783 |
| 3,540,038 | 11/1970 | Taylor et al. | 340/815.26 |
| 3,636,557 | 1/1972 | Watkins | 340/815.08 |
| 4,380,879 | 4/1983 | Seibert | 340/815.24 |

*Primary Examiner*—Marshall M. Curtis
*Assistant Examiner*—Roland Bowler
*Attorney, Agent, or Firm*—Warren H. Kintzinger

[57] ABSTRACT

Large scale information display panels made up of basic picture elements running to hundreds, even up several thousand color elements, are useful for being viewed for advertising, transportation information, traffic control, news, weather, finanical data and other information normally generated by computers. The system has capability in alphanumeric and also for color graphics designs in four colors with use of a basic display element with two intersecting planes rotational about an axis at the intersection of the two planes. A three plane element provides for designs in six colors. The basic two plane display has each face of each of the two plane surfaces coated or impregnated with a different color and a single permanent bar magnet is enclosed in one of the plane forms perpendicular to the axis of rotation. The bar magnet acts as an armature for rotation of the element with current flow through a coil and a holding force with magnetic circuit material resist shifting from a set orientation in a two coil driven configuration. This is with "L" shaped ferrous metal strips providing support for the rotatable display elements and holding a vertical coil and horizontal coil in place for each rotatable display element. Addition of a third coil positioned in element to element dividers for each element and inclusion of a third perpendicular color plane along with two permanent bar magnets at right angles to each other in each element extends the concept to a six color display.

21 Claims, 4 Drawing Sheets

COLOR GRAPHICS INFORMATION DISPLAY

Figure 1:
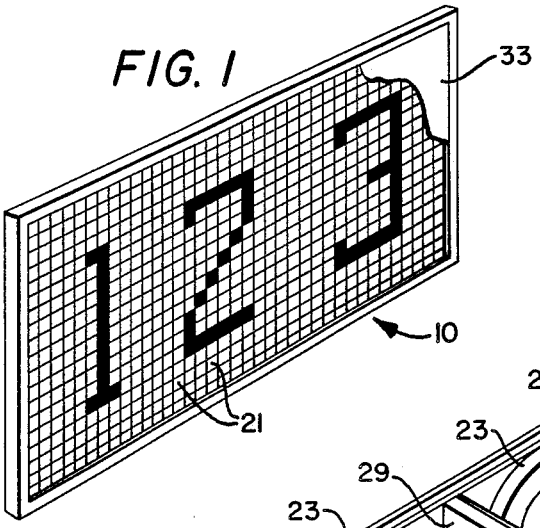

This invention relates in general to color graphics information display systems, and more particularly, to large scale information display panels made up of basic multi-color elements running to hundreds and even to thousands of elements that have multiple intersecting plane projections normal one to another and at least one permanent bar magnet enclosed in one of the plane forms perpendicular to the axis of rotation of the element subject to ninety degree position rotation by current flow through, selectively, one of a plurality of coils for controlled color change positioning of each element through four colors for one embodiment and six colors with another embodiment.

Large scale color graphic displays are useful for in-store advertising, outdoor billboard use, traffic control, shopping malls, airports, sports arenas and for many other uses. Pre-existing technology has made extensive use of incandescent lamps and two-sided flip over disks. It is important that large scale color graphic displays have good readability in high or low ambient light conditions. Multiple foreground and background colors are desired for example six colors including black and white with color change control as needed. Some of the previous display systems impose excessive power requirements making them costly to operate whereas minimum power consumption even zero power except during change cycles is desired. It is important that multiple element displays be made up using simple, inexpensive and easily replaceable color elements that are resistive to effects from weather in the outdoor environment. Such displays should be effective through a wide viewing angle and useful in fully modular display panels that are quickly removeable and that provide flexibility in overall size and aspect ratio. Computer control drive is helpful in providing reasonably fast response color element position setting times.

It is therefore a principal object of this invention to provide an improved color graphics information display that is highly visible in varying degrees of ambient lighting.

Another object is to provide such a graphics display that is cost effective, and easy to service and maintain.

A further object is to provide such a graphics display that imposes minimal power requirements.

Still another object is to provide such a graphics display with multiple foreground and background colors quickly changeable as desired.

Another object is to provide such a display made up of many multi-color display elements each subject to being color position changed by electronic magnetic circuit controls.

A further object is to control such display by computer controls for dramatically effective dynamically changeable displays.

Features of the invention useful in accomplishing the above objects include, in a color graphics information display, display panels made up of basic picture elements running to hundreds even up to several thousand color elements, are useful for being viewed for advertising, transportation information, traffic control, news, weather, financial data and other information generally generated by computers. The system has capability in alphanumeric and also for color graphics designs in four colors with use of a basic display element with two intersecting planes rotational about an axis at the intersection of the two planes. A three plane element provides for design in six colors. The basic two plane display has each face of the two plane surfaces coated or impregnated with a different color and a single permament bar magnet is enclosed in one of the plane forms perpendicular to the axis of rotation. The bar magnet acts as an armature for rotation of the element with current flow through a coil and a holding force with magnetic circuit material resists shifting from a set orientation in a two coil driven configuration. This is with "L" shaped ferrous metal strips providing support for the rotatable display elements and holding a vertical coil and horizontal coil in place for each rotatable display element. Addition of a third coil positioned in element to element dividers for each element and inclusion of a third perpindicular color plane along with two permanent bar magnets at right angles to each other in each element extends the concept to a six color display. The plane elements are symetrical in respective embodiments to facilitate turn positioning of the elements as driven by selective activation of positioning coils. The basic four color display element is designed so that its orientation around its axis of rotation provides for one of its four colors to be visible. For each rotation of ninety degrees a different color is seen by the viewer. The colors may be any combination of colors including black and white and flourescent pigments may be used for very high contrast under ultra violet illumination. The display element consists of two perpendicular planes with the rotational axis at the intersection of the two planes. Each face of each of the two plane element is coated with different color or a pigment is molded into plastic or a color overlay so that each side is a different color. A single permanent bar magnet is captured in a plastic rectangle forming one of the element planes with the bar magnet perpindicular to the axis of rotation. The bar magnet of each element serves two functions with it acting as an armature used for rotation of the element to a specified angular position, and a holding force that prevents shifting from that orientation. Further, each plane element may be ridged or wedged from the axis of rotation outward to minimize color of the adjacent faces from being visible. Four orientation positions of a two plane element are controlled by selective activation of two right angle related coils and the rotating bar magnet. The bar magnet must always come to rest with its center line horizontal or vertical and one of its poles attracted by the horizontal or vertical plane of the ferrous metal "L" shaped mounting strip. Axis of rotation mount extensions are supported in keyed mounting notches in dividers between side by side elements with the dividers including a ferrous metal shield on one side thereof. Element mount extensions may be flat sided as an aid to stabilizing a set position of the element. As an electrical current is passed through a winding of one of the two coils the static magnetic attraction is overcome by the strongler pull of the electromagnet and the display element rotates to a new position and is again held in place by the static magnetic attraction force to the "L" shaped ferrous metal strip. The rotational axis of the display element and the bar magnet is offset vertically and horizontally from the centerlines of the two coils to prevent the display element from ever coming to rest at a "dead center" position.

With reference to the six color display system on additional plane is used and a third coil is supported in a plastic divider with the third coil backed by a ferrous metal shield preventing magnetic lines of force from the coil from affecting adjacent display elements. Each of these elements is containable in an inner sphere floating in a liquid contained in a transparent outer sphere so as to be free to rotate in any plane as controlled by the magnetic field from any one of the three coil windings being energized. In another embodiment the inner sphere is supported on a felt ring for rotation and in another embodiment the inner sphere is supported on a plurality of small balls for freedom of rotation.

Specific embodiments representing what are presently regarded as the best modes of carrying out the invention are illustrated in the accompanying drawings.

Figure 2:
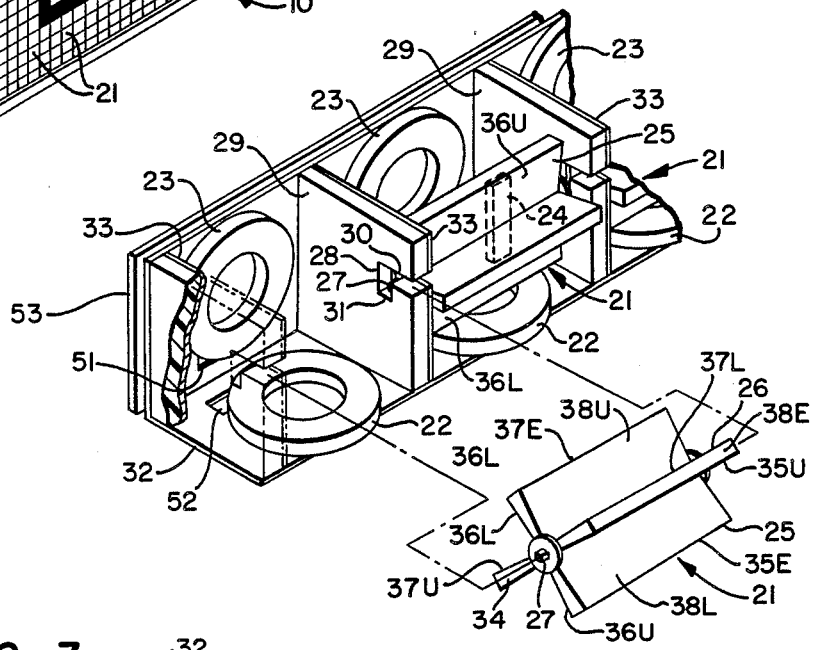
Figure 3:
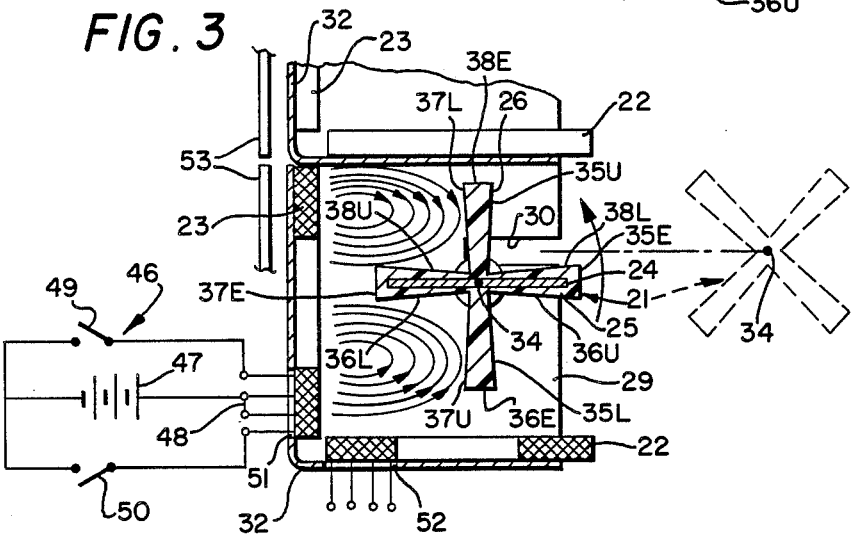
Figure 4:
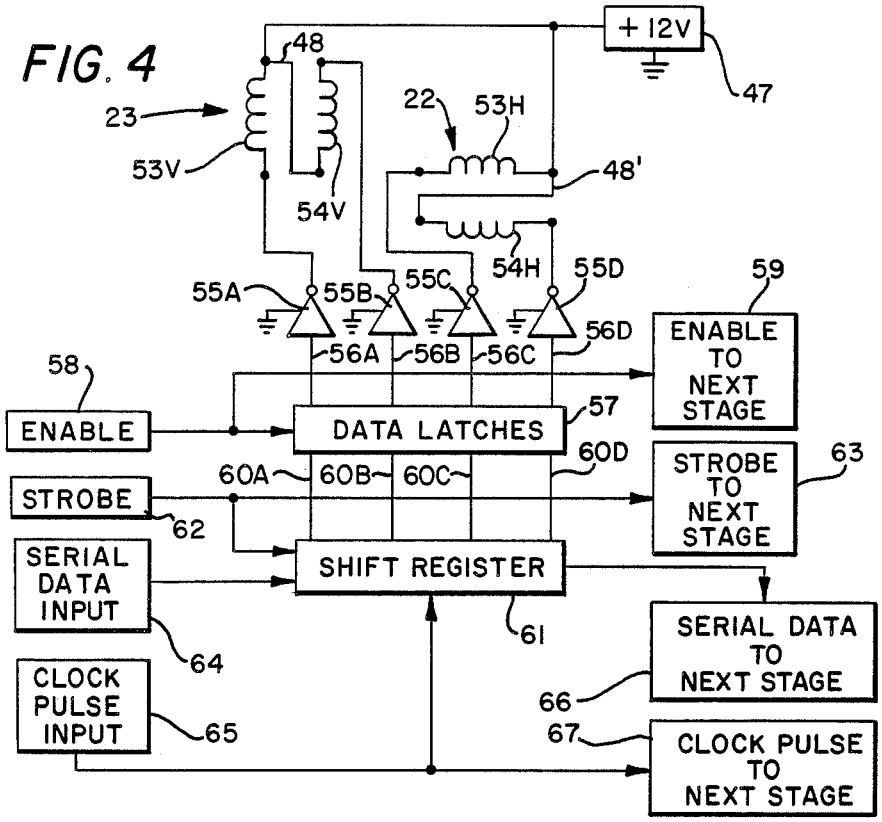
Figure 5A:
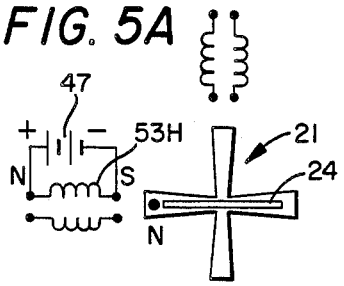
Figure 5B:
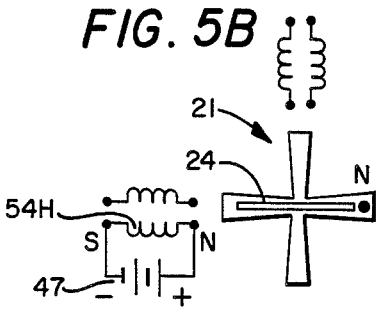
Figure 5C:
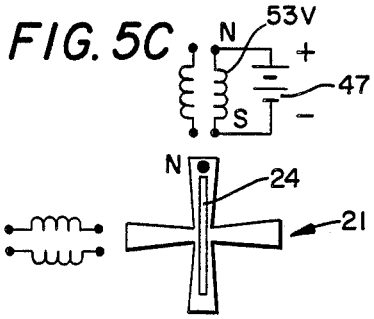
Figure 5D:
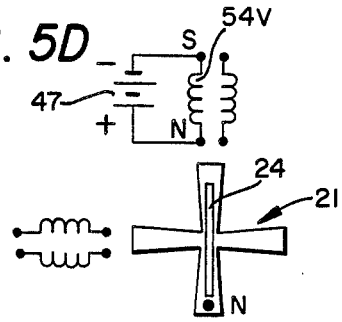
Figure 7:
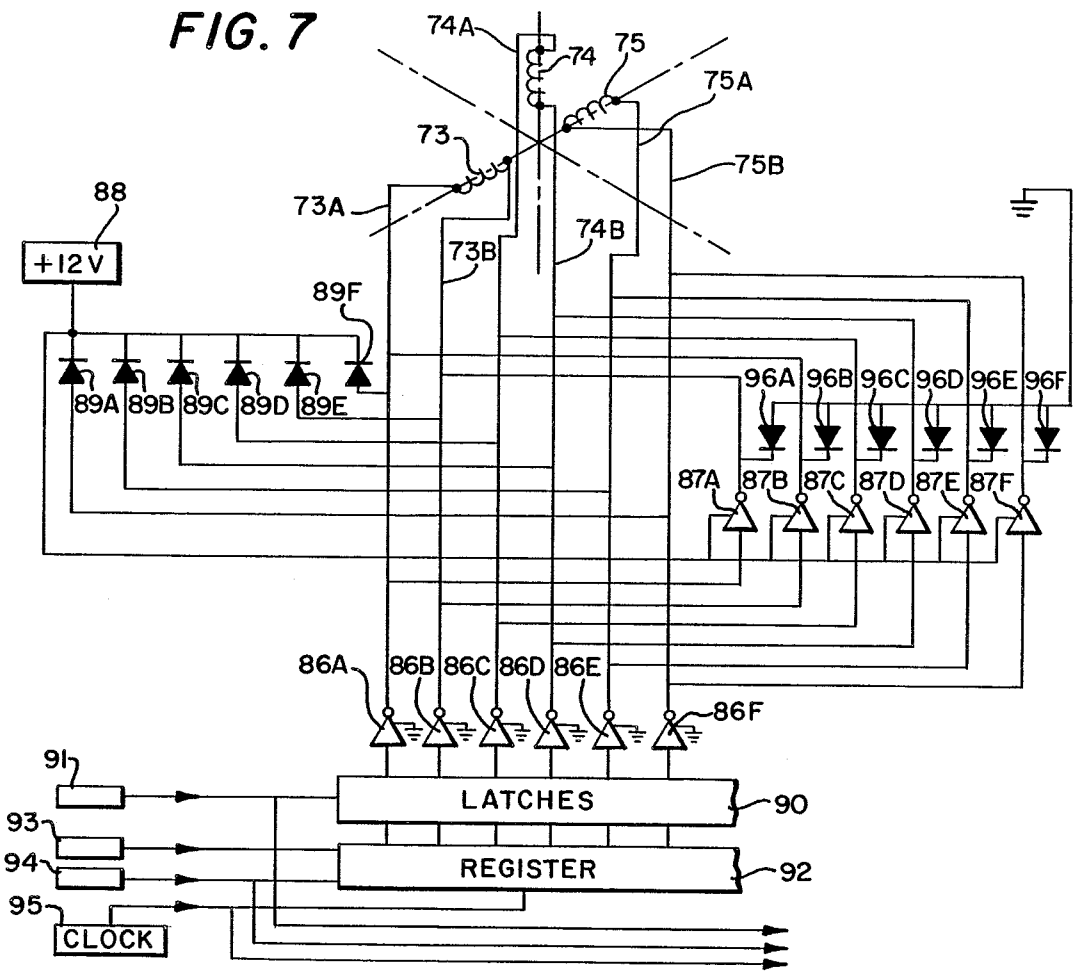
Figure 6:
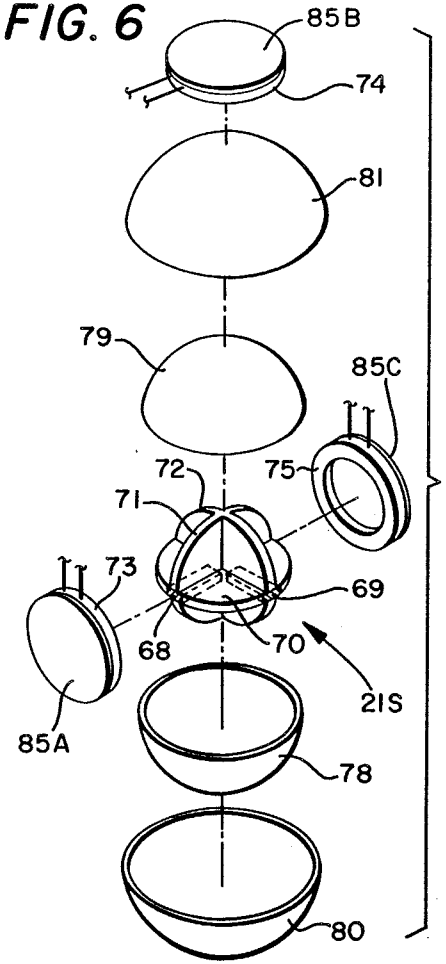
Figure 11:
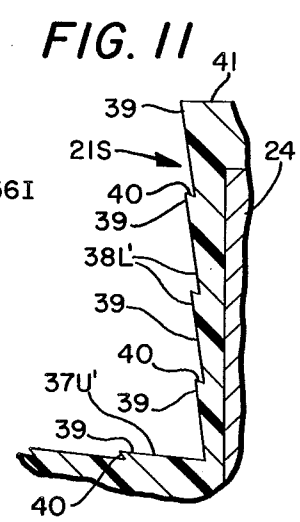
Figure 10:
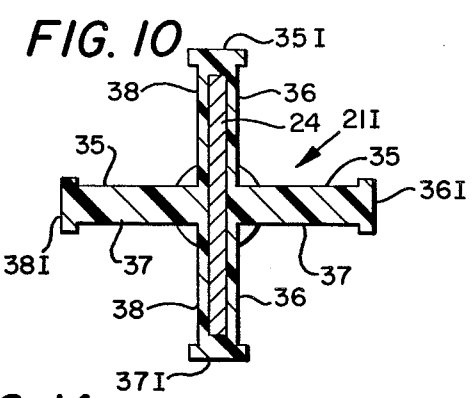
Figure 14:
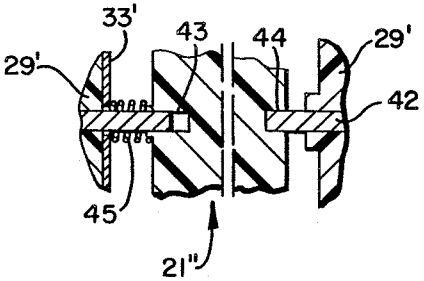
Figure 8:
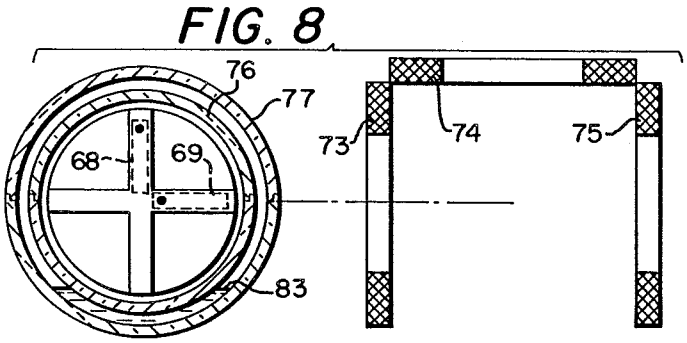
Figure 13:
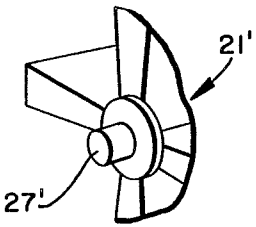
Figure 12:
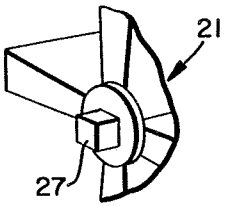
Figure 9C:
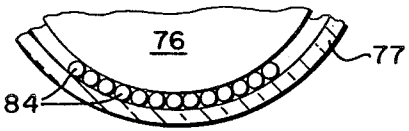
Figure 9B:
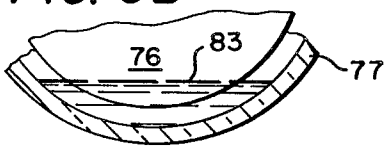
Figure 9A:
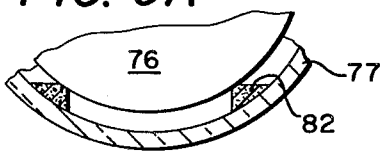

In the drawings:

FIG. 1 represents a perspective view of a multi-element color graphics information display panel;

FIG. 2, a partial cut-away, partially in phantom and partially exploded view of the color element and element support structure for a display panel;

FIG. 3, a partial cut-away and sectioned side elevation view through an element, the two coils therefor, and the "L" shaped ferrous metal mount member for a row of elements;

FIG. 4, the block schematic control system for controlled activation of the two coils in moving a color display element from one color display position to the next;

FIGS. 5A, 5B, 5C and 5D, bar magnet and element positions for different coil current flow states;

FIG. 6, an exploded perspective view of a six color double sphere enclosed display element;

FIG. 7, a partial electronic control circuit block diagram schematic for a six color display element;

FIG. 8, a double sphere six color display element with two right angle related bar magnets enclosed therein lifted away from the three coil control configuration used therewith;

FIGS. 9A, 9B and 9C show three rotatable color element support embodiments, a felt ring, fluid and a plurality of small balls permitting free rotation of the sphere relative to it's support;

FIG. 10, an element useable as the multi-elements having enlarged outer edges;

FIG. 11, an element emodiment with step ridged color faces;

FIG. 12, a partial perspective view of an element showing a flat sided (square) end mounting extension;

FIG. 13, a partial perspective view of an element with a round pin end mounting extension; and FIG. 14, a partial cut away and sectioned view showing mounting detail of elements with round pin divided wall mounting extensions.

Referring to the drawings:

The display panel 10 of FIG. 1 is shown to have many multi-color elements 21 that may be flipped from one color position to another as individually driven by electro magnetic coils 22 and 23 acting on a permanent magnet 24 imbedded in each element 21. The basic multi-color display element 21 of the FIGS. 2–5D embodiment has two intersecting plane portions 25 and 26 normal to each other mounted for rotation about the axis of the intersection of the two planes with opposite end extensions 27 supported in keyed mounting notches 28 in the dividers 29 between side by side elements 21. The mounting notches 28 are formed with a horizontal slot 30 and a downward extension 31 holding the respective element ends 27 with an end 27 of one element 21 supported therein along with the end 27 of an adjacent element 21. It should be noted that end extensions 27 are flat sided (i.e. square) as an aid to stabilizing a set position of the element 21. A ferrous metal "L" shaped member 32 is provided for each horizontal row of elements 21 that functions both as a mounting support for coils 22 and 23 and as part of a magnetic circuit for each of the coils 22 and 23. The "L" shaped member 32 also supports the dividers 29 between side by side elements 21 and have a ferrous metal shield 33 on one side thereof. Each bar magnet 24 acts as an armature for rotation of its element 21 with driving current flow through a coil 22 or 23 and otherwise has a holding force with the magnetic circuit material of "L" shaped member 32 that resists shifting from a set orientation. This is either north pole attraction or south pole attraction depending on the set position of the element 21. Display panels 20 are generally provided with a transparent front protective facing 33 as a protection for elements 21 from the elements particularly in the outside environment wtih wind, rain, hail and snow.

Each of the two intersecting plane portions 25 and 26 of a multi-color display element 21 has opposite projections projecting outward from the intersecting central axis of rotation 34 substantially equidistant therefrom in a balanced rotatable design. Further, each display element 21 presents four color display areas including the common facing sides 35U and 35L, 36U and 36L, 37U and 37L and 38U and 38L of the two intersecting plane portions 25 and 26 that may be rotated into forward facing viewing positions by four ninety degree step settings. The display elements 21, and 21' of FIG. 13 that has a round mounting end pin 27' for each end of the display element 21', in place of the flat sided end pin 27 of the elements 21 as shown in FIG. 12, have wedge shaped sections less in thickness at the common joined center and greater in thickness at the outer ends 35E, 36E, 37E and 38E. This minimizes viewing row element set color with the outer ends 35E, 36E, 37E and 38E either a neutral color or colored the same as the corresponding facing sides 35U and 35L, 36U and 36L, 37U and 37L and 38U and 38L. A similar desired color appearance effect is provided with the element 21I embodiment that has enlarged 35I, 36I, 37I and 38I ends either a neutral color or colored the same as the corresponding facing sides 35, 36, 37 and 38. With the FIG. 11 element 21S embodiment the display faces 35U' and 35L', 36U' and 36L', 37U' and 37L' and 38U' and 38L' each have a plurality of steps 39 with outer facing ends 40 and the plane portion outer ends 41 either a neutral color or colored the same as the corresponding facing sides. These basic element designs provide for set orientations around an axis to present one of four colors for viewing. When a horizontal axis is chosen the viewing angle extends through almost 180 degrees but is limited to a smaller viewing angle in the vertical plane. The four colors may be any combination of colors and tints including black and white and fluorescent pigments are useable for very high contrast under ultra violet illumination. Each display element 21 is generally of non-magnetic material with a single permanent bar magnet 24 captured in one of the plastic rectangles forming one of two perpendicular plane portions 25 and 26. Each face of each of the two plane surfaces is coated with a different color or a pigment is molded into the plastic so that each side is a different color. It should be noted that the elements 21 may be removed from their mountings with ends 27 resting in extensions 31 of mounting notches 28 in divider 29 by lifting them and then drawing them forward for removal but they must be turned forty five degrees to clear the ferrous metal "L" shaped member 32 of the element 21 row thereabove as indicated in FIGS. 2 and 3 for such removal.

With reference to the display element 21" embodiment of FIG. 14 pins 42 are mounted in divider walls 29' with ferrous metal shield 33' and extend therethrough and into opposite end openings 43 and 44 of each element 21" and a spring 45 biases the element 21" to maintain its mounted position on the pins 42. Referring back again to FIGS. 2 and 3 the four position settings for an element 21 are control set by coils 22 and 23 each of which may be a single wire wound coil with current on-off and reverse switching control. Coils 22 and 23 could also be bifilar two wire wound coils with four terminals as shown in FIG. 3 where a control circuit 46 such as shown schematically for coil 23 would also have to be provided for bifilar coil 22. Control circuit 46 is shown as having a DC voltage supply 47 with one side connected in common 48 to a terminal of each winding and with the other terminal of each winding connected through a switch 49 and 50 respectively, to the other side of DC voltage supply 47. Electrical line connections for the coil windings extend through slots 51 and 52 in the "L" shaped members 32 to printed circuit boards 53 mounted behind the ferrous metal "L" shaped members 32. The two coils 22 and 23 are allocated to each color display element for selecting one of four colors. A serial shift register is connected so that one "bit" on each of its outputs will enable one driver switch and one coil winding. A multiplicity of color display elements 21 are assembled as a horizontal row, or vertical column if desired, with the output of each shift register connected to the input of the following shift register. The control computer outputs a serial bit stream of ones and zeros to the display element row to control color for each successive color display element. If several rows are stacked vertically for panel display, the STROBE control line allows selective addressing of each row in the "stack". The ENABLE control line will allow the current to flow for a specified time as the graphical presentation is changed in each row or the entire display panel.

The four element 21 magnetic operation set positions are controlled by coils 22 and 23 and the rotatable bar magnet 24 that must always come to rest in a set position with its center line horizontal or vertical with one of its poles attracted by the horizontal or vertical portion of a ferrous metal "L" shaped member 32 strip. Either the north (N) or the south (S) pole of each rotatable bar magnet 24 will be attracted to the member 32 strip to insure that the rotatable display element 21 is perfectly aligned when at rest and to resist vibration or shock movement that otherwise would tend to shift element 21 static position. As an electric current is passed through a winding of one of the coils 22 or 23, other than for its instant static position, the static magnetic attraction is overcome by the stronger pull (or push) of the electromagnet and the display element rotates to the new position and is again held by static attraction force with the member 32 strip.

The rotational axis of the display element 21 and the bar magnet is offset vertically and horizontally from the centerlines of the fixed coils 22 and 23. This offset prevents the display element 21 from ever coming to rest in a "dead center" position that would prevent the magnetic force caused by either coil 22 or 23 from causing rotation of the display element. As an alternate guard against the "dead center" the computer program that controls the display can briefly energize one of the coil windings 90 degrees from the desired final position. This intermediate positioning of the element 21 conserves power since less energy is required for 90 degree rotation than 180 degree rotation. Rotation to any one of the four 90 degree positions occurs when an electrical current of the proper magnitude and direction of flow is passed through one of the coils. The field produced by coil 22 or 23 covers a relatively large area in the vicinity of the coil since the coils have no iron core. The large area field is further enhanced by the flat "pancake" coil configuration and the ferrous metal plane against which the coils are mounted. The magnetic design is based upon the need for a large area of flux lines encompassing the area of the display element 21. Precise centering of the display element after each rotation is effected by the ferrous metal mounting shelf and backplane member 32. The combinded results of the overall magnetic configuration provides a relatively low power means causing a specified rotation and positive stop for each display element 21 after reaching its desired position. The flat "pancake" coils are desirable because of minimal visual obstruction from the viewed face of the graphics display panel 10. An advantage of large pancake coils is to increase magnetic flux flux area in which a display element rotates. The flat ferrous metal shield below the coil acts as the opposite pole for the flat electromagnet and provides a low reluctance path for magnetic lines of force, thereby increasing flux density in the display element area. Lower activating currents are the result of the large diameter flat coil configuration.

The schematic block diagram of FIG. 4 shows the control system for controlled activation of two bifilar coils 22 and 23 in moving a color display element from one color display position to the next. Both the vertical and horizontal coils 23 and 22 each consist of two wire windings and 53V and 54V, and 53H and 54H, respectively, with the leads of the two windings of each coil transposed so that current flow therethrough is in opposite directions. Each of these windings has its own electronic driver 55A, 55B, 55C and 55D each with a connection to ground and with individual latch activating input connections 56A, 56B, 56C and 56D from data latch circuit 57 that receives enable inputs from enable source 54 that also feeds to the enable to next stage circuitry 59. The data latch circuit 57 also receives inputs via connections 60A, 60B, 60C and 60D from shift register circuit 61 that in turn receives an input from strobe source 62 that is also connected to strobe to next stage circuit 63, and serial data input source 64 along with a clock signal from clock pulse input source 65 to also provide serial data to the next stage 66. The clock pulse input source 65 is also connected as the clock pulse to next stage 67. FIGS. 5A, 5B, 5C and 5D are simplified schematic showings of different coil winding 53H, 54H, 53V and 54V, respectively, activations and the corresponding resultant bar magnet 24 and element 21 set positions.

Three plane elements provide for design displays in six colors with the three planes of each element in mutually perpendicular relation. One approach with three plane elemtents is for a single bar magnet or a flat ceramic magnet to be held in one plane with, in addition to the two coils of the four color embodiment, inclusion of a third coil positioned in element to element dividers for each element. Such a three plane element may be enclosed in a sphere or be a cube with either being moveable to six different settings displaying six different color faces. Mechanically the sphere is easier to orient to the desired face and does not require a turning radius as does the cube. The six color sphere can form many color combinations for the foreground and background which is ideal for graphics presentation.

In the spherical three plane six color element 21S embodiments of FIGS. 6, 7, 8, 9A, 9B and 9C it should be noted that two permanent bar magnets 68 and 69 at right angles to each other are mounted in plane 70 of three mutually perpendicular planes 70, 71 and 72. The two bar magnets 68 and 69 extend from the periphery of the plane 70 they are mounted in to adjacent the center of the plane 70 and the sphere of planes 70, 71 and 72 with the polarity of the bar magnets 68 and 69 reversed with the north pole of one adjacent the south pole of the other adjacent the center of plane 70. Further, the three coils 73, 74 and 75 for each spherical element 21S are in a "U" configuration one over the top (or at the rear) and the other two on opposite sides. With this embodiment each element 21S is enclosed within two concentric spheres 76 and 77 both hollow clear plastic or glass spheres with the inner sphere 76 containing the three disk planes 70, 71, and 72 and the two bar magnets 68 and 69 mountd in the disk plane 70. The inner sphere 76 is made from two hemispheres 78 and 79 fastened together and the larger outer sphere 77 is made from two hemispheres 80 and 81 also fastened together. The outer sphere 77 serves as a housing for the inner sphere 76 and the three coils 73, 74 and 75 are mounted in "U" configuration thereabout for causing controlled movement to the six different settings of the inner sphere 76. The inner sphere 76 is supported in the outer sphere 77 by a felt ring 82 for relative turning movement thereof as shown in FIG. 9A, or floated by fluid 83 such as a light oil as shown in FIG. 9B, or with a plurality of small balls 84 as shown in FIG. 9C. Ferrous metal plates 85A, 85B and 85C or sheets are placed over the outer sides of the electromagnetic coils 73, 74, and 75 as rear magnetic path media and shields and as a magnetic force attraction media for static holding force with the bar magnets 68 and 69 in the six various electromagnetic coil set positions. This holding force prevents set position drift movement of the inner sphere when no current is flowing in any one of the coils 73, 74 or 75. The bar magnets are sealed in one of the three color disks during assembly and each of the three color disks are mutually perpendicular to the others and the six sides of the assembled disks are each a different color. The different color surfaces are opaque depending upon external illumination that may be daylight, floodlamps, or ultraviolet light sources with fluorescent coatings required on the disk surfaces.

The schematic block diagram of FIG. 7 shows the control system for controlled activation of the electromagnetic coils 73, 74 and 75 both as to the coil activated and the direction of current flow therethrough. Each of the coils 73, 74 and 75 are single wire windings that can be driven with a current in either direction as control activated by sink drivers 86A, 86B, 86C, 86D, 86E and 86F each establishing a ground when activated and the current source drivers 87A, 87B, 87C, 87D, 87E and 87F having voltage source 88 connections, only one of each being activated at any one time to establish current flow through a coil 73, 74 or 75 and the direction of current flow through the coil. Each of the coil lines 73A and 73B, and 74A and 74B and 75A and 75B are connected through protection diodes 89A, 89B, 89C, 89D, 89E and 89F to the +12 volt source 88 to absorb any voltage surges that exceed twelve volts. The latches control circuit 90 that receives an input from output enable source 91 has input connections from register circuit 92 to develop individual latch activate signals to one sink driver 86(A–F) at a time with each sink driver 86(A–F) also having an output connection to a current source driver 87(A–F). The register circuit 92 receives inputs from serial data source 93, strobe pulse source 94 and from clock source 95. The current source drivers 87(A–F) have individual connections through diodes 96 (A–F) cathodes to ground as a protection against voltage surge excursions below ground.

The result of an electrical current of the proper magnitude flowing in one of the coils is to orient the inner sphere in one of six planes thereby exposing one color surface to the viewer. In changing from one color to another, the inner sphere will be required to rotate either 90 degrees or 180 degrees which may be marginal since maximum magnetic torque (pull/push) will occur when an individual magnet is at right angles to the axis of an activated electromagnetic coil. The computer program that controls display element positioning can be set to energize two coils quickly in succession with the last coil energized moving the color element to the final and correct orientation for the desired color setting. This approach absolves any requirement that the computer program retain in memory the previous sphere orientation. The first coil energized may be either of the other two with current flow in either direction. In control of sphere element positioning a serial bit stream would be loaded into the shift register from the computer with each sequence of six bits controlling a display element. Each of the six bit words would contain a single one (1) bit and five zero (0) bits with the position of the one (1) bit determining the color orientation of the respective display element.

Whereas this invention has been described with respect to several embodiments thereof, it should be realized that various changes may be made without departure from the essential contributions to the art made by the teachings hereof.

I claim:

1. A color graphics information display with a plurality of mutually adjacent display elements comprising: a plurality of display elements with each element having a plurality of intersecting mutually perpendicular substantially planar portions; mounting means for said display elements with said display elements rotatable in said mounting means; permanent magnet means mounted in each of said display elements; a plurality of electromagnetic coils mounted in said information display in close proximity to each of said display elements with said coils being in substantially right angle relationship one to the other; current driving control means connected to each of said coils; wherein each of said coils is backed by ferrous metal plating providing a holding force with the permanent magnet means of the associated display elements fixing set positions of said display elements; and each of said coils are flat pancake type coils without iron cores projecting relatively large areas of flux into the area of respective display elements when current is passed through said coils.

2. The color graphics information display of claim 1, wherein ferrous metal shielding is provided between adjacent display elements.

3. The color graphics information display of claim 1, wherein said display elements have two intersecting plane sections with different colors on each side of each plane section; with the intersecting axis of said two intersecting plane sections being at the center of each plane section with substantially equal length portions extending outwardly from the intersecting axis; with the intersecting axis of said two intersecting plane sections being an axis of rotation of said display element; and mounting means mounting opposite ends of said display element for rotation of said display element around its axis from one set position to another.

4. The color graphics information display of claim 3, wherein said permanent magnet means is a bar magnet mounted perpendicular to said axis of rotation of said display element.

5. The color graphics information display of claim 4, wherein said bar magnet is enclosed in one of said two intersecting plane sections.

6. The color graphics information display of claim 5, wherein said bar magnet extends substantially from one edge of a plane section to the opposite edge of the same plane section.

7. The color graphics information display of claim 3, wherein said mounting means includes a combination display element divider and mount.

8. The color graphics information display of claim 7, wherein said display elements are provided with end mounting projections; and said combination display element divider and mounts are provided with a keyed mounting notches with a key depression holding end mounting projections of two adjacent display elements.

9. The color graphics information display of claim 8, wherein said end mounting projections of said display elements are round.

10. The color graphics information display of claim 8, wherein said end mounting projections of said display elements are flat sided as an aid to to stabilizing set positions of said display elements.

11. The color graphics information display of claim 3, wherein said substantially equal portions of each plane section are wedge shaped wtih enlarged outer edge.

12. The color graphics information display of claim 3, wherein said substantially equal length portions of each plane section are terminated in enlarged "T" shaped outer edges.

13. The color graphics information display of claim 3, wherein said substantially equal length portions of each plane section are formed with a plurality of steps on each side with each step having outer facing ends.

14. The color graphics information display of claim 1, wherein said ferrous metal plating is in the form of "L" shaped channeling underlying and backing, respectively, bottomed positioned coils and back coils in respective horizontal rows of display elements.

15. The color graphics information display of claim 1, wherein said coils are bifilar coils.

16. The color graphics information display of claim 1, wherein said display elements have three intersecting plane sections with different colors on each side of each plane section in a six color display element; and three coils with each display element with each coil at right angles to at least one of the other coils.

17. The color graphics information display of claim 16, wherein said display elements have two transparent spheres one mounted by mounting means for relative movement within the other sphere; and with three intersecting plane sections contained within the inner sphere.

18. The color graphics information display of claim 17, wherein said mountin means is liquid.

19. The color graphics information display of claim 17, wherein said mounting means is a support ring of low friction material.

20. The color graphics information display of claim 17 wherein said mounting means is a plurality of small balls.

21. The color graphics information display of claim 16, wherein said permanent magnet means is two permanent bar magnets mounted in each of said display elements at right angles to each other and with the north pole of one adjacent the south pole of the other permanent magnet at the center of said display element.

* * * * *